US010435834B2

(12) United States Patent
Wright et al.

(10) Patent No.: US 10,435,834 B2
(45) Date of Patent: Oct. 8, 2019

(54) WASHING MACHINE APPLIANCE WITH A BULK DISPENSE RESERVOIR HAVING AN INTEGRAL BLEACH CUP

(71) Applicant: Haier US Appliance Solutions, Inc., Wilmington, DE (US)

(72) Inventors: Troy Marshall Wright, Louisville, KY (US); Alexander B. Leibman, Prospect, KY (US); Christopher Gene Vowels, Cox's Creek, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 245 days.

(21) Appl. No.: 15/234,002

(22) Filed: Aug. 11, 2016

(65) Prior Publication Data

US 2018/0044839 A1 Feb. 15, 2018

(51) Int. Cl.

| | |
|---|---|
| ***D06F 39/02*** | (2006.01) |
| *D06F 39/12* | (2006.01) |
| *D06F 23/04* | (2006.01) |
| *D06F 33/02* | (2006.01) |

(52) U.S. Cl.

CPC ..... *D06F 39/02* (2013.01); *D06F 23/04* (2013.01); *D06F 33/02* (2013.01); *D06F 39/022* (2013.01); *D06F 39/12* (2013.01); *D06F 2204/02* (2013.01); *D06F 2204/08* (2013.01)

(58) Field of Classification Search

CPC ..... D06F 39/02; D06F 39/022; D06F 39/026; A47L 15/4418

See application file for complete search history.

(56) References Cited

U.S. PATENT DOCUMENTS

| | | | | |
|---|---|---|---|---|
| 4,160,367 | A | 7/1979 | Vona, Jr. | |
| 4,203,307 | A * | 5/1980 | Obata | D06F 39/02 137/268 |
| 8,056,747 | B2 | 11/2011 | Vitan et al. | |
| 9,027,370 | B2 | 5/2015 | Leibman et al. | |
| 2012/0125055 | A1* | 5/2012 | Lee | D06F 39/02 68/17 R |
| 2014/0190216 | A1* | 7/2014 | Leibman | D06F 39/02 68/12.18 |
| 2014/0373284 | A1* | 12/2014 | Leibman | D06F 39/022 8/137 |
| 2015/0135780 | A1* | 5/2015 | Ajiki | D06F 39/022 68/17 R |

FOREIGN PATENT DOCUMENTS

| | | | | |
|---|---|---|---|---|
| EP | 2133456 | A1 * | 12/2009 | D06F 39/02 |
| EP | 2604743 | A2 * | 6/2013 | D06F 39/02 |
| EP | 2604744 | A2 * | 6/2013 | D06F 39/02 |

* cited by examiner

*Primary Examiner* — Marc Lorenzi
(74) *Attorney, Agent, or Firm* — Dority & Manning, P.A.

(57) ABSTRACT

A washing machine appliance includes an additive reservoir positioned below a top panel of the washing machine appliance for receiving large quantities of a first fluid additive, such as detergent. In addition, the additive reservoir defines an additive passageway that extends through the additive reservoir and is configured for receiving a second fluid additive, such as bleach, and directing that additive directly into a tub of the washing machine appliance. In this manner, bulk detergent and an additional additive may be added into the washing machine appliance without requiring the manufacturing and assembly of two separate parts which must be installed within the limited space under the top panel of the washing machine appliance.

10 Claims, 8 Drawing Sheets

WASHING MACHINE APPLIANCE WITH A BULK DISPENSE RESERVOIR HAVING AN INTEGRAL BLEACH CUP

FIELD OF THE INVENTION

The present subject matter relates generally to washing machine appliances, such as vertical-axis washing machine appliances, with bulk dispense reservoirs.

BACKGROUND OF THE INVENTION

Washing machine appliances can use a variety of fluid additives (in addition to water) to assist with washing and rinsing a load of articles. For example, detergents and/or stain removers may be added during wash and prewash cycles of washing machine appliances. In addition, fabric softeners may be added during rinse cycles of washing machine appliances. As another example, bleach may be added to whiten clothes or to clean or disinfect washing machine appliances.

Fluid additives are preferably introduced at an appropriate time during the operation of washing machine appliance and in a proper volume. By way of example, adding insufficient volumes of either the detergent or the fabric softener to the laundry load can negatively affect washing machine appliance operations by diminishing efficacy of a cleaning operation. Similarly, adding excessive volumes of either the detergent or the fabric softener can also negatively affect washing machine appliance operations by diminishing efficacy of a cleaning operation.

Consequently, as a convenience to the consumer, certain washing machine appliances include systems for automatically dispensing detergent and/or fabric softener. Such systems include a bulk storage tank that can store one or more fluid additives in bulk and dispense such fluid additives during operation of the washing machine appliances. However, such bulk tanks occupy a substantial portion of the limited space available underneath the top cover of the washing machine appliance. As a result, space restrictions limit the potential size and position of other fluid additive dispensers, such as a bleach dispenser cup. Moreover, additional additive dispensers require the molding, assembly, and installation of additional parts, thus increasing manufacturing time, cost, and complexity.

Accordingly, a washing machine appliance having features for improving the dispensing of fluid additives would be useful. More particularly, a bulk tank with features for dispensing additional fluid additives with fewer parts to manufacture and install would be especially beneficial.

BRIEF DESCRIPTION OF THE INVENTION

The present subject matter provides a washing machine appliance. The washing machine appliance includes an additive reservoir positioned below a top panel of the washing machine appliance for receiving large quantities of a first fluid additive, such as detergent. In addition, the additive reservoir defines an additive passageway that extends through the additive reservoir and is configured for receiving a second fluid additive, such as bleach, and directing that additive directly into a tub of the washing machine appliance. In this manner, bulk detergent and an additional additive may be added into the washing machine appliance without requiring the manufacturing and assembly of two separate parts which must be installed within the limited space under the top panel of the washing machine appliance. Additional aspects and advantages of the invention will be set forth in part in the following description, or may be apparent from the description, or may be learned through practice of the invention.

In a first exemplary embodiment, a washing machine appliance is provided. The washing machine appliance includes a cabinet having a top panel, the top panel of the cabinet defining a first opening and a second opening. A tub is disposed within the cabinet below the top panel and a basket is rotatably mounted within the tub. An additive reservoir is positioned below the top panel, the additive reservoir defining a reservoir inlet positioned at the first opening of the top panel and an additive passageway that extends through the additive reservoir between an inlet positioned at the second opening of the top panel and an outlet.

In a second exemplary embodiment, an additive reservoir for a washing machine appliance is provided. The additive reservoir includes a top wall and a bottom wall, the bottom wall being spaced apart from the top wall along a vertical direction. A reservoir inlet is defined on the top wall of the additive reservoir, the reservoir inlet being configured for receiving a first fluid additive. An additive passageway extends through the additive reservoir between an inlet positioned at the top wall and an outlet positioned at the bottom wall, the additive passageway being configured for receiving a second fluid additive.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
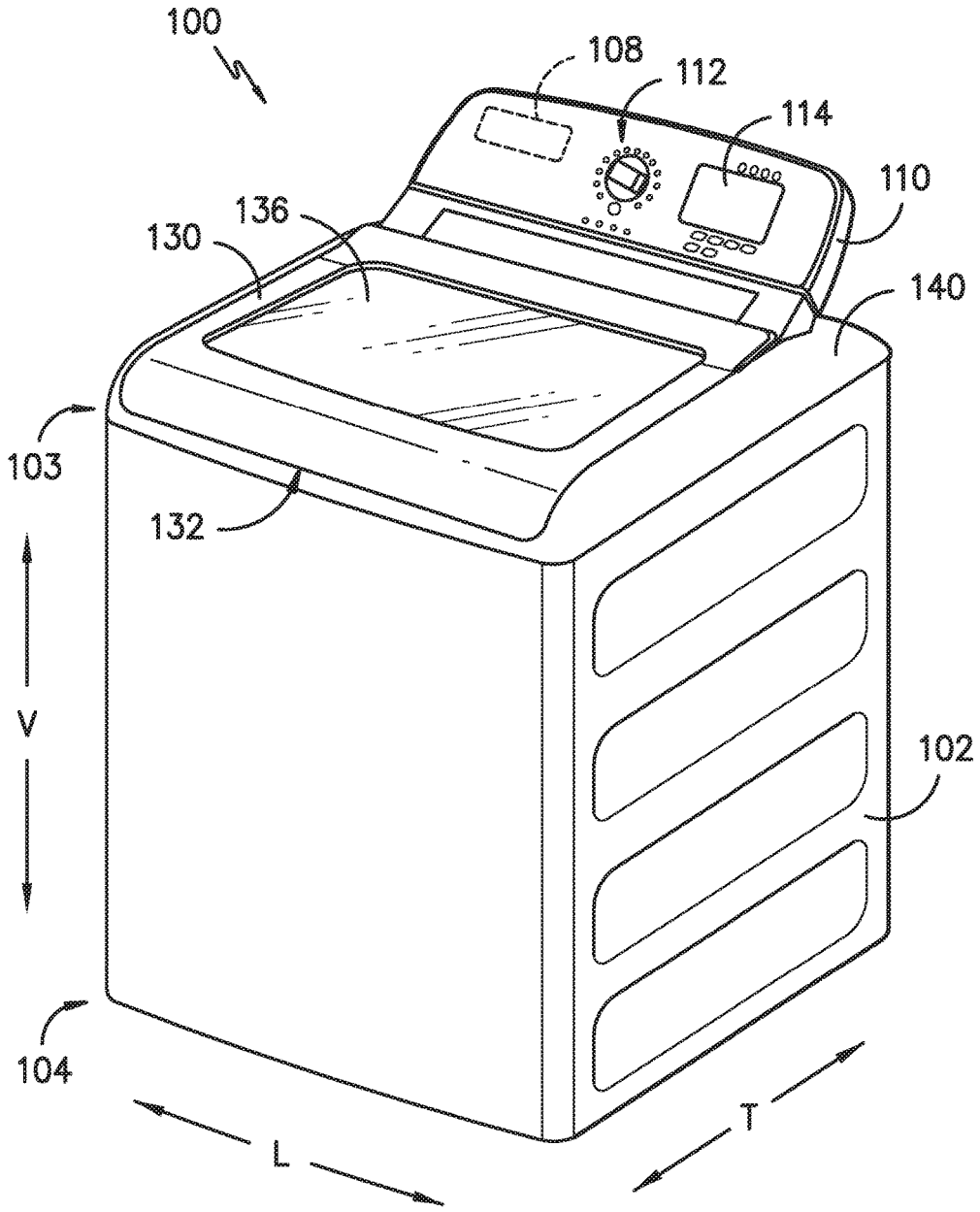
FIG. 1 provides a perspective view of a washing machine appliance according to an exemplary embodiment of the present subject matter with a door of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
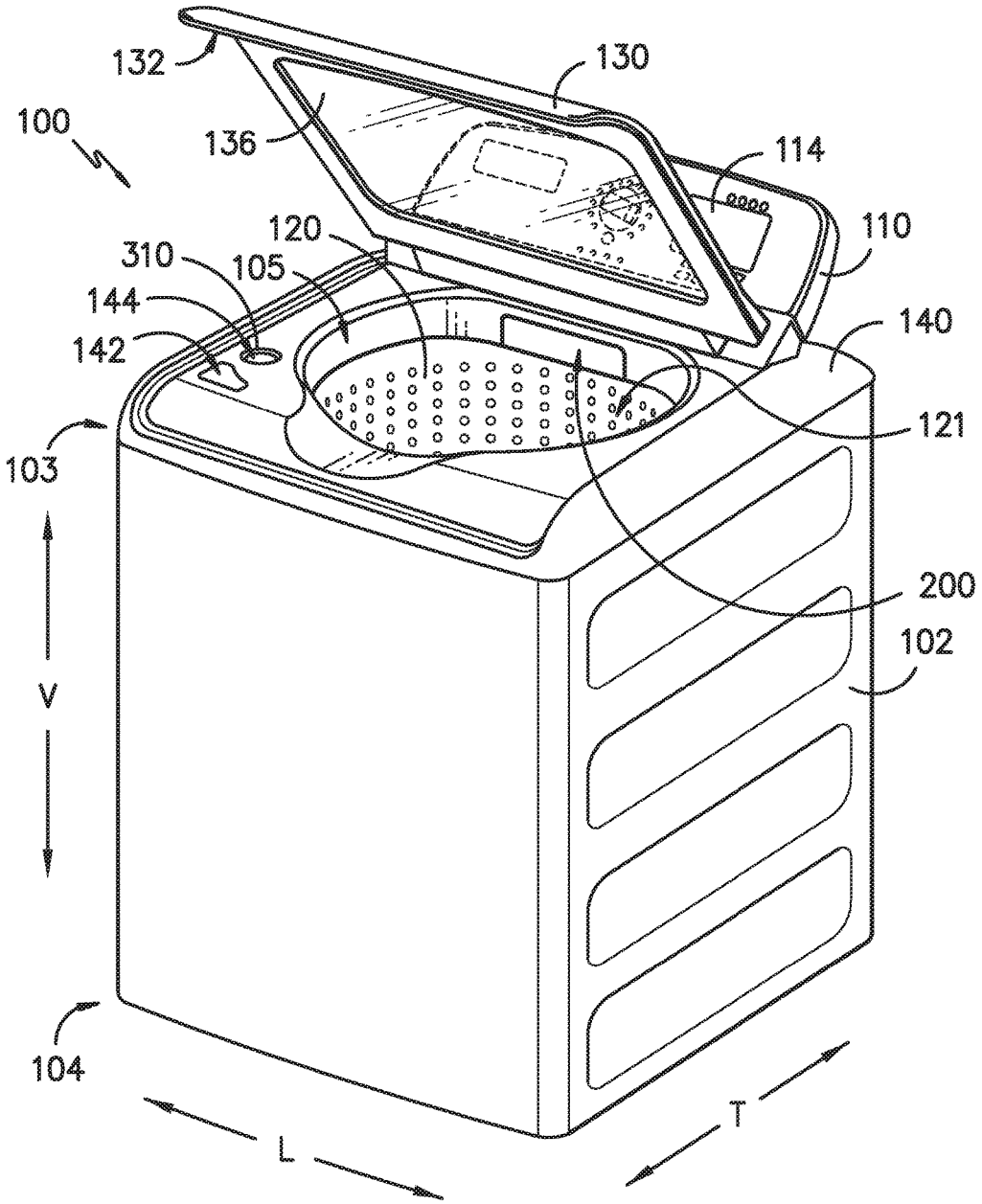
FIG. 2 provides a perspective view of the exemplary washing machine appliance of FIG. 1 with the door of the exemplary washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, which are mutually perpendicular with one another, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash tub 118 (FIG. 6) is disposed within cabinet 102, and a wash basket 120 is rotatably mounted within tub 118. A motor (not shown) is in mechanical communication with wash basket 120 to selectively rotate wash basket 120 (e.g., during an agitation or a rinse cycle of washing machine appliance 100). Wash basket 120 defines a wash chamber 121 that is configured for receipt of articles for washing. Tub 118 holds wash and rinse fluids for agitation in wash basket 120 within tub 118. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140, e.g., at top portion 103 of cabinet 102. Top panel 140 defines an aperture 105 that permits user access to wash basket 120 of tub 118. Door 130, rotatably mounted to top panel 140, permits selective access to aperture 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

Top panel 140 also defines one or more apertures for receiving various fluid additives. For example, according to the exemplary illustrated embodiment, top panel 140 defines a first opening, e.g., detergent opening 142, at a corner of top panel 140 at or adjacent a front portion of top panel 140 as shown in FIG. 2, for receiving detergent and/or fabric softener. Detergent opening 142 permits the fluid additive to pass through top panel 140 to a reservoir 260 (FIG. 6) disposed below top panel 140 along the vertical direction V. Thus, a user may pour the fluid additive into reservoir 260 through detergent opening 142 in top panel 140.

In addition, top panel 140 defines a second opening, e.g., bleach opening 144, adjacent detergent opening 142, for receiving bleach. According to the illustrated embodiment, bleach opening 144 is positioned closer to a rear portion of top panel 140 and a control panel 110 relative to detergent opening 142. Bleach opening 144 permits the fluid additive to pass through top panel 140 directly into wash tub 118, as discussed in more detail below with respect to FIGS. 7 and 8. According to alternative embodiments, openings 142, 144 may be configured for receipt of one of a plurality of fluid additives, e.g., detergent, fabric softener, and/or bleach.

A control panel 110 with at least one input selector 112 extends from top panel 140, e.g., at a rear portion of cabinet 102 opposite detergent opening 142 about aperture 105 along the transverse direction T. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through aperture 105, and washing operation is initiated through operator manipulation of input selectors 112. Tub 118 is filled with water and detergent and/or other fluid additives via dispenser box assembly 200, which will be described in detail below. Alternatively, certain additives may be provided directly into wash tub 118, e.g., by pouring through opening 105 or bleach opening 144. For example, a user may add bleach or another suitable fluid additive directly into wash tub 118 at any time through bleach opening 144. One or more valves can be controlled by washing machine appliance 100 to provide for filling wash basket 120 to the appropriate level for the amount of articles being washed, rinsed, or otherwise treated. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through aperture 105.

Referring now generally to FIGS. 2 through 5, dispenser box assembly 200 will be described in more detail. Although described in greater detail below in the context of washing machine appliance 100, it will be understood that dispenser box assembly 200 may be used in or with any other suitable washing machine appliance in alternative exemplary embodiments. In addition, other configurations of dispenser box assembly 200 may be provided as well. For example, dispenser box assembly 200 may be positioned on a front of cabinet 102, may have a different shape or chamber configuration, and may dispense water, detergent, or other additives. Other variations and modifications of the exemplary embodiment described below are possible, and such variations are contemplated as within the scope of the present subject matter.

Figure 3:
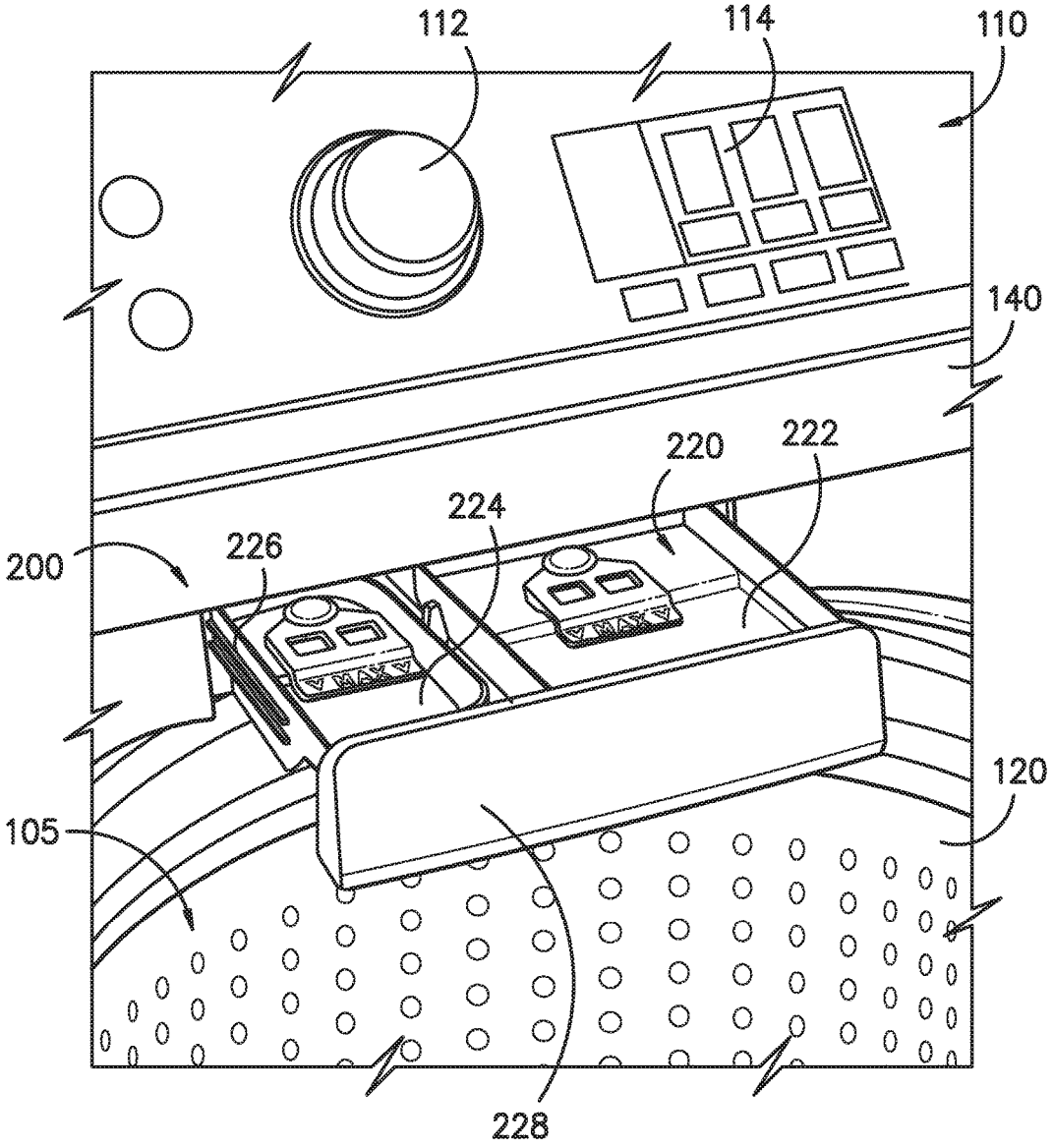
FIG. 3 provides a front, perspective view of an exemplary dispenser box assembly installed in the exemplary washing machine appliance of FIG. 1.
Figure 4:
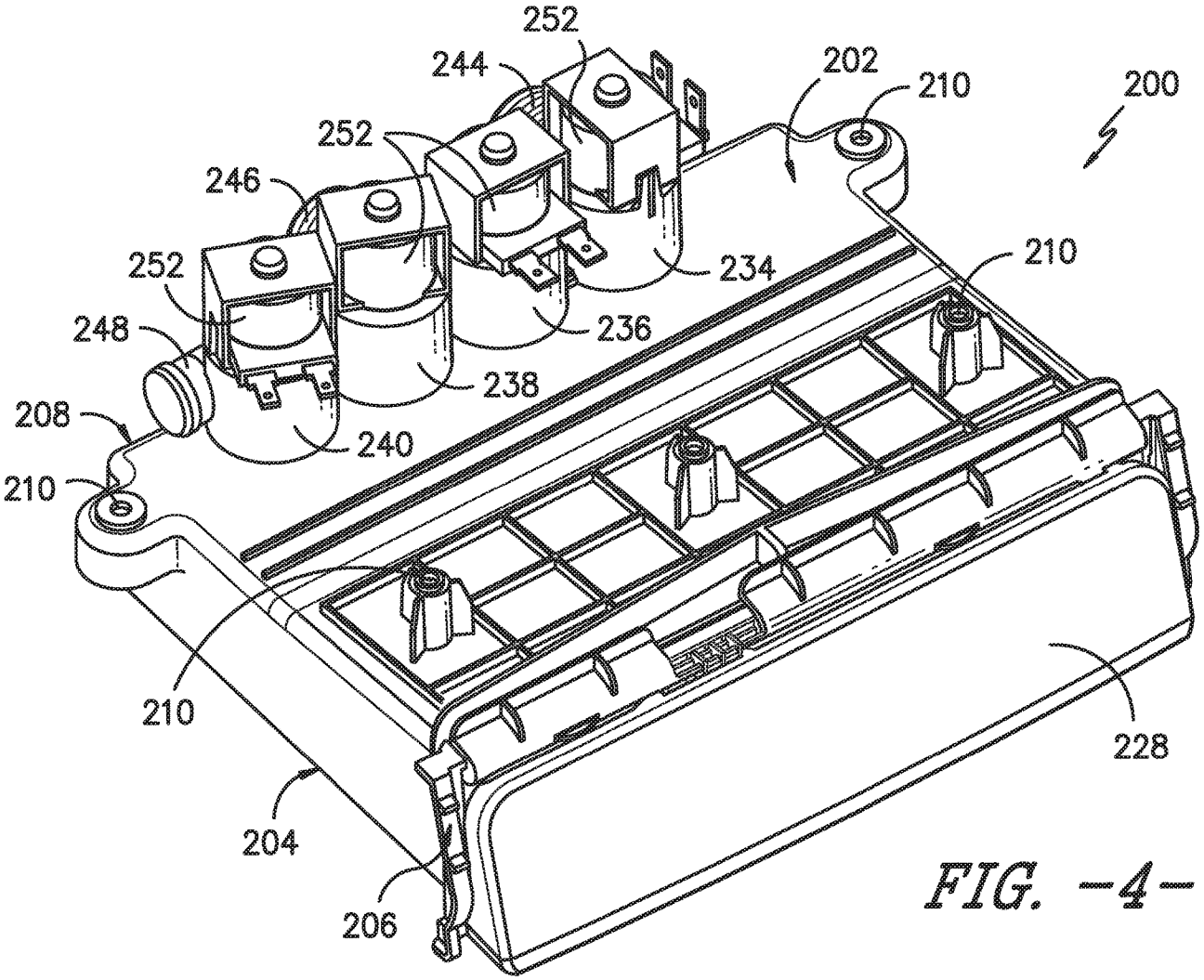
FIG. 4 provides a front, perspective view of the exemplary dispenser box assembly of FIG. 3.

Dispenser box assembly 200 is a box having a substantially rectangular cross-section that defines a top 202 and a bottom 204, e.g., spaced apart along the vertical direction V. Dispenser box assembly 200 also defines a front side 206 and a back side 208, e.g., spaced apart along the transverse direction T. As best shown in FIGS. 2 and 3, dispenser box assembly 200 may be mounted underneath top panel 140 of cabinet 102, e.g., at a rear portion of cabinet 102, such that front side 206 is visible inside aperture 105. More specifically, dispenser box assembly 200 may be mounted to top panel 140 using a plurality of mounting features 210, which may, for example, be configured to receive mechanical fasteners. One skilled in the art will appreciate that dispenser box assembly 200 may be mounted in other locations and use other mounting mechanisms in alternative exemplary embodiments.

Dispenser box assembly 200 may define a mixing chamber 220 configured to receive one or more additive compartments. For example, according to the illustrated embodiment, mixing chamber 220 may be configured to slidably receive a detergent compartment 222 and a softener compartment 224. Detergent and softener compartments 222, 224 are slidably connected to the mixing chamber 220 using slides 226 and are connected to a front panel 228 of dispenser box assembly. In this manner, a user may pull on front panel 228 to slide detergent and softener compartments 222, 224 along the transverse direction T. Once extended, detergent compartment 222 and softener compartment 224 may be conveniently filled with detergent and softener, respectively. Front panel 228 may be then be pushed back into mixing chamber 220, e.g., before a wash cycle begins.

Although the illustrated embodiment shows detergent compartment 222 and softener compartment 224 slidably received in mixing chamber 220 for receiving wash additives, one skilled in the art will appreciate that different configurations are possible in alternative exemplary embodiments. For example, more compartments may be used and the compartments may be accessed by a lid instead of sliding out of mixing chamber 220. In addition, as discussed in greater detail below, mixing chamber 220 may draw wash additives from a separate storage container such that sliding compartments 222, 224 may be removed from mixing chamber 220.

Dispenser box assembly 200 may further include a plurality of valves configured to supply hot and cold water to mixing chamber 220 or directly to tub 118. For example, according to the illustrated embodiment, a plurality of apertures may be defined on top 202 of mixing chamber 220 for receiving water. Each aperture (not shown) may be in fluid communication with a different portion of the mixing chamber 220. A plurality of valve seats may be positioned over top of each of those apertures to receive a valve that controls the flow of water through each aperture.

For example, a first valve seat 234 may be in fluid communication with a first aperture for providing hot water into detergent compartment 222. A second valve seat 236 may be in fluid communication with a second aperture for providing cold water into detergent compartment 222. A third valve seat 238 may be in fluid communication with a third aperture for providing cold water into softener compartment 224. A fourth valve seat 240 may be in fluid communication with a fourth aperture for providing cold water into mixing chamber 220 or directly into tub 118.

Water inlets may be placed in fluid communication with each of valve seats 234, 236, 238, 240. More specifically, a hot water inlet 244 may be connected to a hot water supply line (not shown) and a cold water inlet 246 may be connected to a cold water supply line (not shown). According to the illustrated embodiment, each water inlet 244, 246 may include a threaded male adapter configured for receiving a threaded female adapter from a conventional water supply line. However, any other suitable manner of fluidly connecting a water supply line and water inlets 244, 246 may be used. For example, each water supply line and water inlets 244, 246 may have copper fittings that may be sweated together to create a permanent connection.

Figure 5:
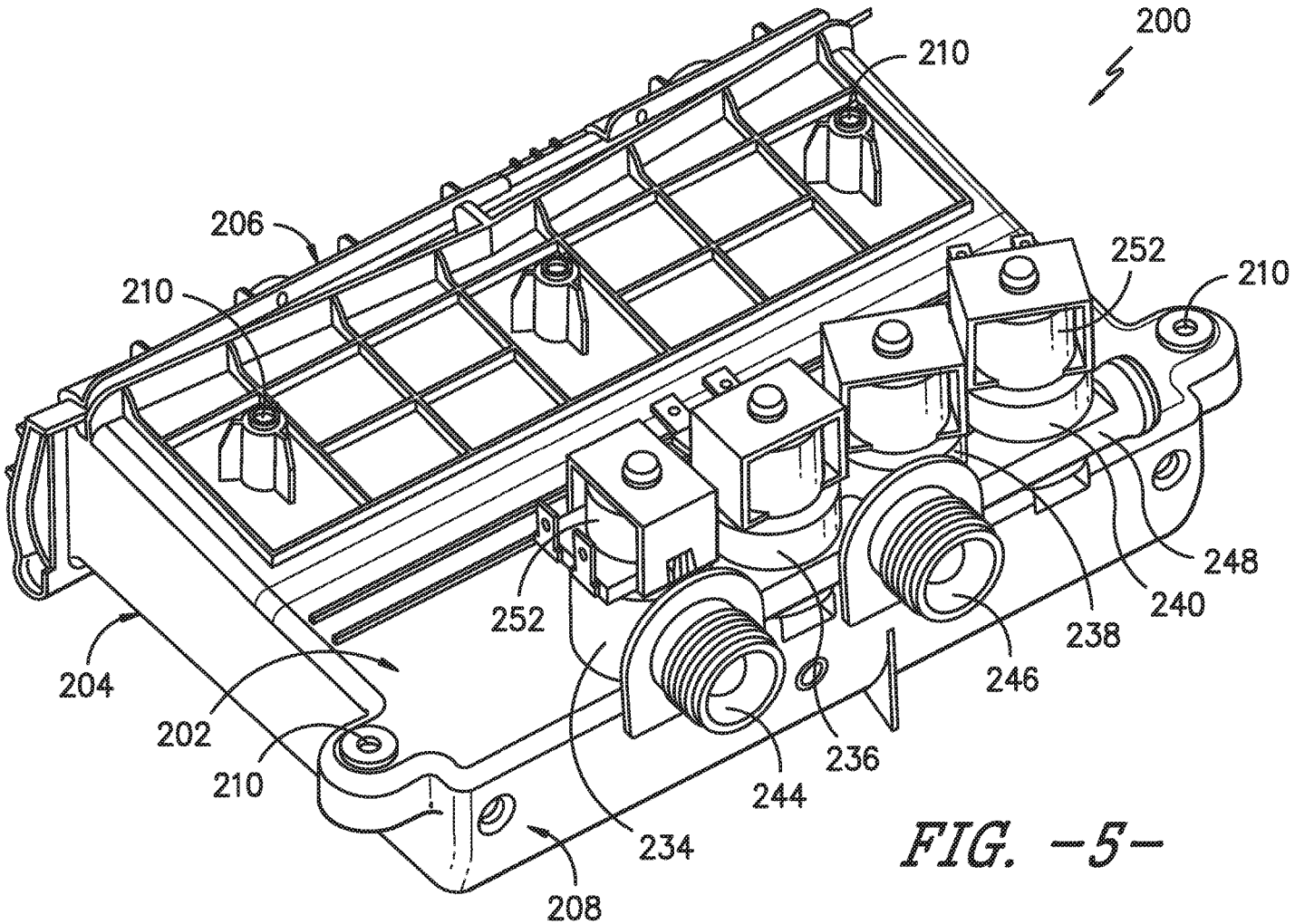
FIG. 5 provides a rear, perspective view of the exemplary dispenser box assembly of FIG. 4.

Notably, hot water inlet 244 is in direct fluid communication with first valve seat 234. However, because washing machine appliance 100 uses cold water for multiple purposes, cold water inlet 246 is in fluid communication with a cold water manifold 248. As best shown in FIG. 5, cold water manifold 248 is a cylindrical pipe that extends along the lateral direction L from second valve seat 236 to fourth valve seat 240. In this manner, cold water manifold 248 places valve seats 236, 238, 240 in fluid communication with cold water inlet 246.

Each of valve seats 234, 236, 238, 240 may be configured to receive a water valve 252 for controlling the flow of water through a corresponding aperture into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through first valve seat 234 and from cold water manifold 248 through one or more of second valve seat 236, third valve seat 238, and fourth valve seat 240.

Dispenser box assembly 200 may also include one or more outlets (not shown) for directing wash fluid, such as water and/or a mixture of water and at least one fluid additive, e.g., detergent, fabric softener, and/or bleach into tub 118 from dispenser box assembly 200. For example, when second valve seat 236 is open, water may flow from cold water inlet 246 through cold water manifold 248 and second valve seat 236 into detergent compartment 222. Water may mix with detergent placed in detergent compartment 222 to create wash liquid to be dispensed into tub 118.

An outlet (not shown) may be positioned on the bottom of detergent compartment 222 or on the bottom of mixing chamber 220 to dispense the wash fluid into tub 118. According to the illustrated embodiment, dispenser box assembly 200 may include four outlets; each associated with a respective one of valves seats 234, 236, 238, 240. However, it will be understood that different outlet configurations may be used in alternative exemplary embodiments. For example, outlets may be positioned on a bottom of mixing chamber 220 near tub 118 or directly on tub 118, but could be positioned in other locations as well.

Figure 6:
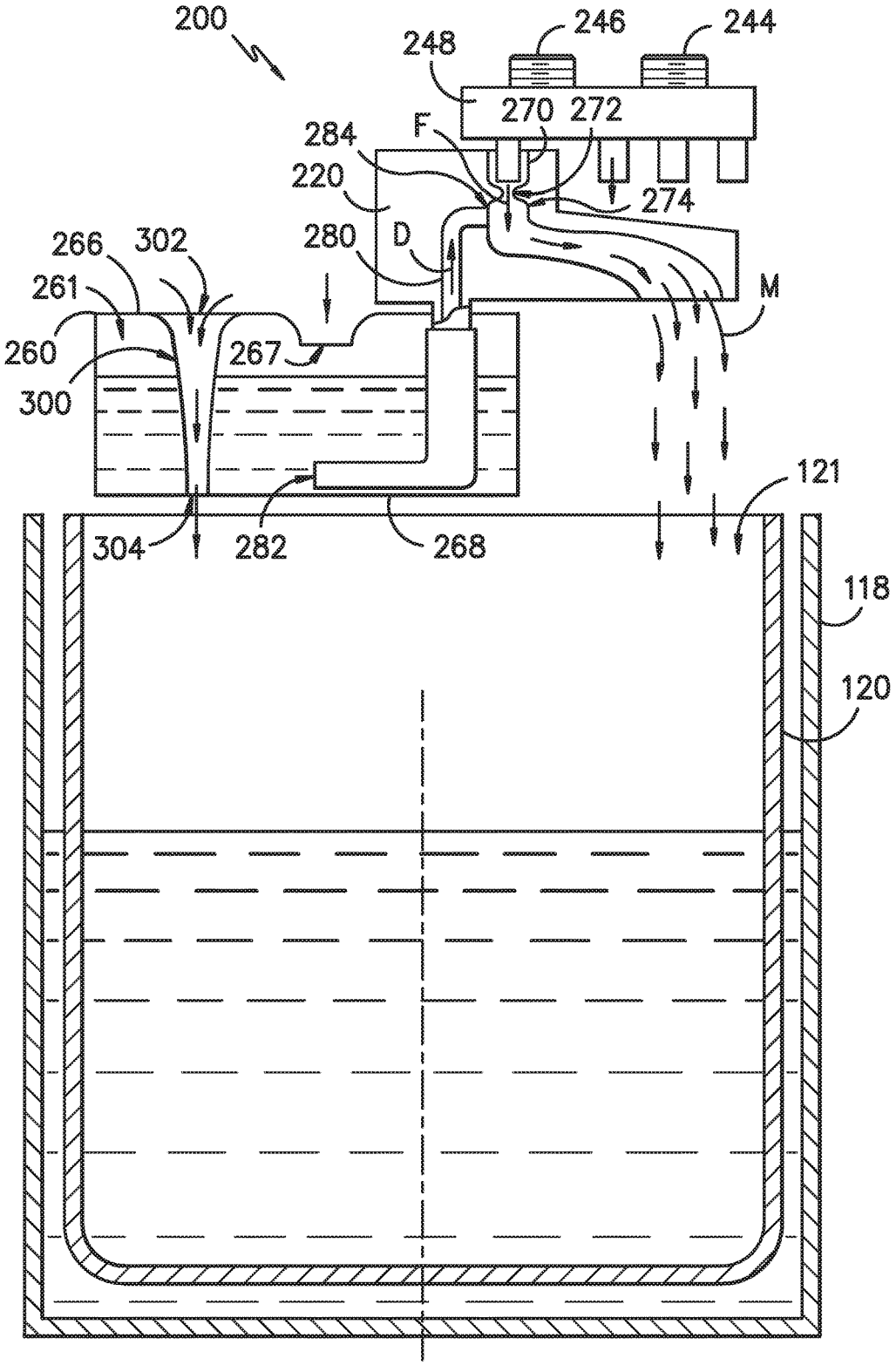
FIG. 6 provides a schematic view of certain components of the exemplary washing machine appliance of FIG. 1.
Figure 7:
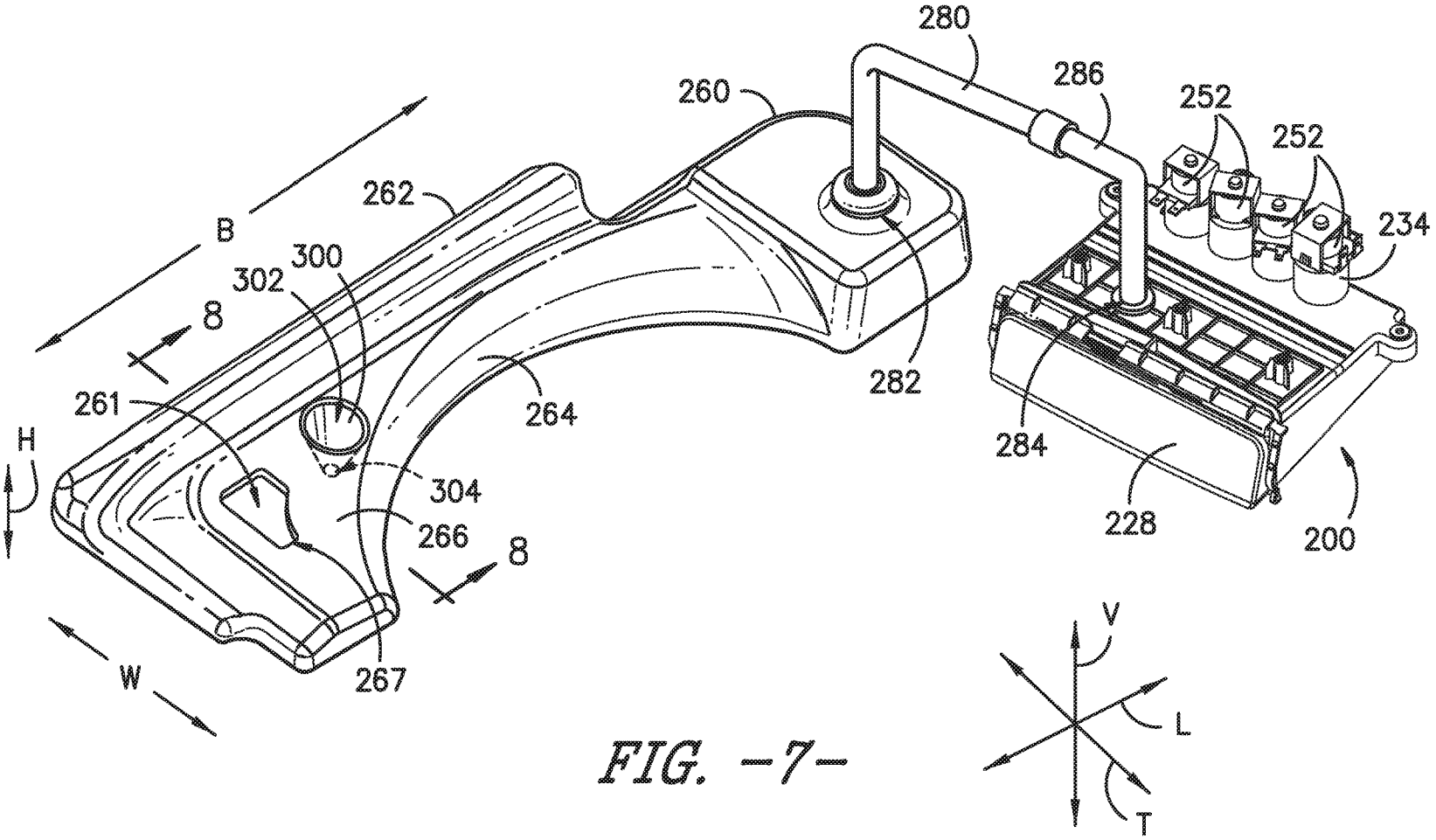
FIG. 7 provides a perspective view of a reservoir of the exemplary washing machine appliance of FIG. 1 fluidly coupled to the exemplary dispenser box assembly of FIG. 3.
Figure 8:
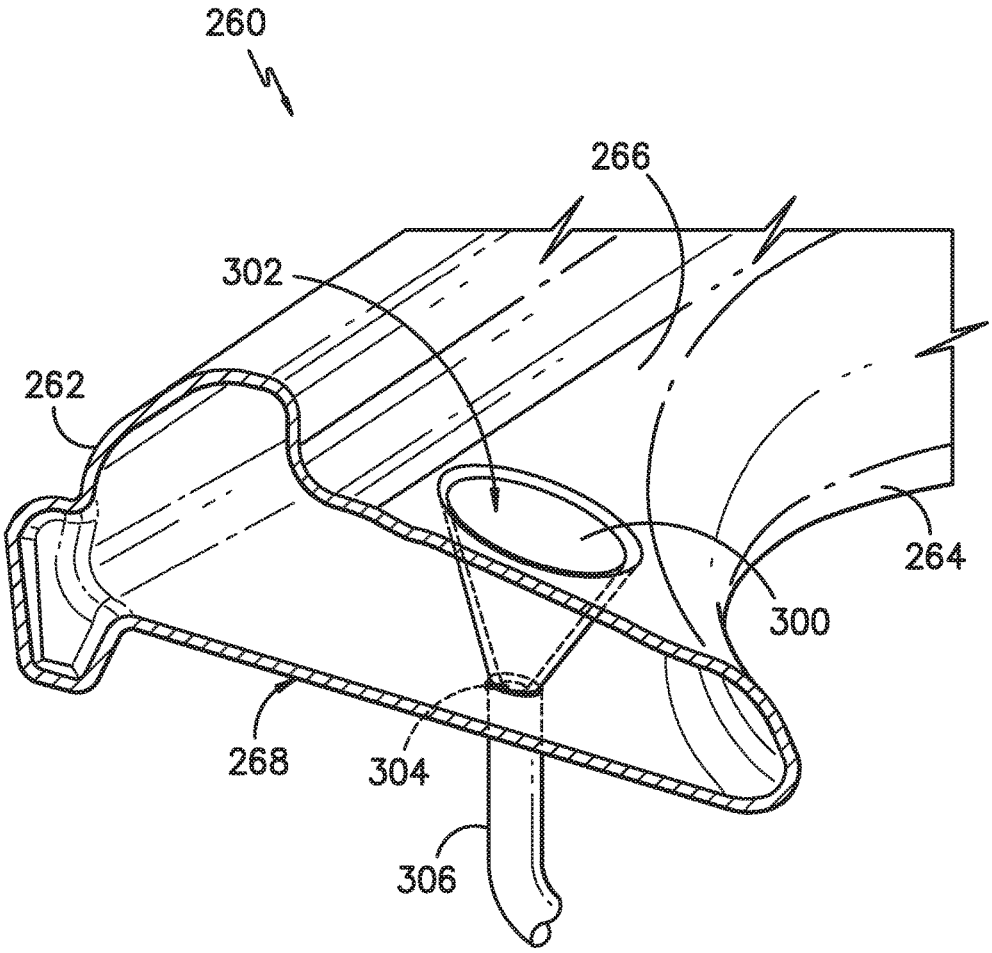
FIG. 8 provides a cross sectional view of the exemplary reservoir of FIG. 7, taken along Line 8-8 of FIG. 7.

FIG. 6 provides a schematic view of certain components of washing machine appliance 100. FIG. 7 provides a perspective view of a reservoir 260 of washing machine appliance 100 fluidly coupled to dispenser box assembly 200. FIG. 8 provides a cross sectional view of reservoir 260. Although described in greater detail below in the context of washing machine appliance 100 and dispenser box assembly 200, it will be understood that reservoir 260 may be used in or with any other suitable washing machine appliance and/or without dispenser box assembly 200, in alternative exemplary embodiments. In addition, other configurations of reservoir 260 may be provided as well. For example, reservoir 260 may be positioned on a front of cabinet 102, may have a different shape or chamber configuration. Other variations and modifications of the exemplary embodiment described below are possible, and such variations are contemplated as within the scope of the present subject matter.

Reservoir 260 may be filled with detergent, and washing machine appliance 100 includes features for drawing detergent within reservoir 260 to dispenser box assembly 200. Within dispenser box assembly 200, the detergent from reservoir 260 is mixed with water and directed into tub 118 of washing machine appliance 100. Thus, reservoir 260 may contain a bulk volume of detergent (e.g., or other suitable fluid additive) such that reservoir 260 is sized for holding a volume of detergent sufficient for a plurality of wash cycles of washing machine appliance 100, such as no less than twenty wash cycles, no less than fifty wash cycles, etc. As a particular example, an internal volume 261 of reservoir 260 is configured for containing detergent therein, and the internal volume 261 of reservoir 260 may be no less than twenty fluid ounces, no less than three-quarters of a gallon or about one gallon. As used herein the term "about" means within half a gallon of the stated volume when used in the context of volumes. Thus, a user can avoid filling dispenser box assembly 200 with detergent before each operation of washing machine appliance by filling reservoir 260 with detergent.

As discussed above, reservoir 260 is positioned below top panel 140 (FIG. 2). In particular, an inlet 267 of reservoir 260 may be positioned at (e.g., directly below) detergent opening 142 of top panel 140. Thus, a user may pour detergent into reservoir 260 via detergent opening 142 of top panel 140 in order to load or fill reservoir 260 with detergent. Although inlet 267 is described herein as receiving detergent, it should be appreciated that inlet 267 may be used for supplying reservoir 260 with other additives, such as fabric softener, while remaining within the scope of the present subject matter.

Reservoir 260 includes a planar sidewall 262, an arcuate sidewall 264, a top wall 266, and a bottom wall 268. Planar sidewall 262 and arcuate sidewall 264 of reservoir 260 are spaced apart from each other, e.g., along the lateral direction L. Top wall 266 and a bottom wall 268 of reservoir 260 are also spaced apart from each other, e.g., along the vertical direction V. Planar sidewall 262 and arcuate sidewall 264 of reservoir 260 may extend along the vertical direction V between top wall 266 and a bottom wall 268 of reservoir 260 in order to connect top wall 266 of reservoir 260 to bottom wall 268 of reservoir 260. Reservoir 260 may also include end walls (not labeled) that are spaced apart from each other, e.g., along the transverse direction T, and that extend along the vertical direction V between top wall 266 and bottom wall 268 of reservoir 260 in order to connect top wall 266 of reservoir 260 to bottom wall 268 of reservoir 260. Reservoir 260 may be formed from any suitable material, such as molded plastic. In addition, reservoir 260 may be contoured such that reservoir 260 is complementary to the profile of top panel 140.

Reservoir 260 has a height H along the vertical direction V. The height H of reservoir 260 may be defined between top wall 266 and bottom wall 268 of reservoir 260. Reservoir 260 also has a width W along the lateral direction L. The width W of reservoir 260 may be defined between planar sidewall 262 and arcuate sidewall 264 of reservoir 260 (e.g., at the portion of reservoir 260 where planar sidewall 262 and arcuate sidewall 264 of reservoir 260 are most spaced apart from each other along the lateral direction L). Reservoir 260 further has a breadth B along the transverse direction T. The breadth B of reservoir 260 may be defined between the opposing end walls of reservoir 260.

Reservoir 260 may be sized such that reservoir 260 is shorter along the vertical direction V than along the transverse direction T and/or the lateral direction L. For example, the height H of reservoir 260 may be no greater than six inches or no greater than four inches. As another example, the height H of reservoir 260 may be about four inches. As used herein, the term "about" means within half an inch of the stated height when used in the context of heights. Thus, reservoir 260 may have a small profile along the vertical direction V under top panel 140.

In contrast to the low vertical profile of reservoir 260, the width W and/or breadth B of reservoir 260 may be larger than the height H of reservoir 260. For example, the width W of reservoir 260 may be less than twelve inches and greater than six inches or less than ten inches and greater than seven inches. As another example, the width W of reservoir 260 may be about eight inches. As used herein, the term "about" means within an inch of the stated width when used in the context of widths. With respect to the breadth B of reservoir 260, as an example, the breadth B of reservoir 260 may be less than twenty-eight inches and greater than sixteen inches or less than twenty-four inches and greater than eighteen inches. As another example, the breadth B of reservoir 260 may be about twenty-four inches. As used herein, the term "about" means within three inches of the stated breadth when used in the context of breadths. Thus, reservoir 260 may have a small profile along the vertical direction V under top panel 140 while still being sized to contain a significant volume of detergent, e.g., no less than three-quarters of a gallon of detergent.

Washing machine appliance 100 includes various features for drawing detergent from reservoir 260 and directing the detergent into tub 118. For example, washing machine appliance 100 includes a Venturi pump 270 and a supply conduit 280. Supply conduit 280 extends between reservoir 260 and Venturi pump 270, and Venturi pump 270 draws detergent from reservoir 260 when a valve associated with Venturi pump 270 is open and water flows through Venturi pump 270. As an example, Venturi pump 270 may be configured to receive a flow of water F when one valve seat position of water valve 252 is opened (e.g., the water valve 252 on second valve seat 236). Thus, when one valve seat position of water valve 252 is open, the flow of water F may pass through Venturi pump 270.

As may be seen in FIG. 6, Venturi pump 270 may be disposed on or formed with dispenser box assembly 200. In alternative exemplary embodiments, Venturi pump 270 may be disposed on or formed with any other suitable component of washing machine appliance 100. Venturi pump 270 includes a converging section 272 and a diverging section 274. Converging section 272 of Venturi pump 270 is disposed upstream of diverging section 274 of Venturi pump 270 relative to the flow of water F through Venturi pump 270. As the flow of water F enters converging section 272 of Venturi pump 270, the flow of water F may increase in velocity and decrease in pressure. Conversely, as the flow of water passes from converging section 272 of Venturi pump 270 into diverging section 274 of Venturi pump 270, the flow of water F may increase in pressure and decrease in velocity.

Supply conduit 280 extends between an inlet 282 and an outlet 284, e.g., along the lateral direction L. Inlet 282 of supply conduit 280 is disposed within reservoir 260, e.g., at or adjacent bottom wall 268 of reservoir 260. Outlet 284 of supply conduit 280 is disposed at Venturi pump 270. A flow of detergent D may enter supply conduit 280 at inlet 282 of supply conduit 280, flow through supply conduit 280 to Venturi pump 270 and enter Venturi pump 270 via outlet 284 of supply conduit 280.

The change in pressure for the flow of water F through Venturi pump 270 may assist with drawing detergent from reservoir 260. For example, internal volume 261 of reservoir 260 may be exposed to or contiguous with ambient air about washing machine appliance 100 (e.g., via inlet 267 of reservoir 260), and outlet 284 of supply conduit 280 may be positioned on Venturi pump 270 (e.g., converging section 272 of Venturi pump 270 or diverging section 274 of Venturi pump 270) such that a pressure of fluid at outlet 284 of supply conduit 280 is less than the pressure of detergent within reservoir 260 at inlet 282 of supply conduit 280. Thus, Venturi pump 270 may pump the flow of detergent D from reservoir 260 to Venturi pump 270 via supply conduit 280 when the flow of water F passes through Venturi pump 270. Within Venturi pump 270, the flow of water F and the flow of detergent D mix and a mixture of water and detergent M exits Venturi pump 270 and flows into tub 118. In such a manner, detergent from reservoir 260 may be dispensed in to tub 118.

The shape, construction and location of reservoir 260 can assist with providing a very cost-effective bulk dispense system that delivers accurate fluid additive dosing, e.g., without the use of a costly pressure sensor. When Venturi pump 270 is actuated for a predetermined amount of time, the amount of fluid additive dispensed from reservoir 260 to Venturi pump 270 is essentially constant, e.g., because the priming time of Venturi pump 270 is also essentially constant, within a small but acceptable error, whatever the fill level of fluid additive within reservoir 260. For example, the priming time of Venturi pump 270 when reservoir 260 is full will be about equal to the priming time of Venturi pump 270 when reservoir 260 is almost empty due to the low vertical profile of reservoir 260. In particular, the level of fluid additive within reservoir 260 can vary by less than six inches between full and empty such that the priming time of Venturi pump 270 is similar in both circumstances.

As may be seen in FIG. 7, a middle portion 286 of supply conduit 280 between inlet and outlet 282, 284 of supply conduit 280 may be positioned above inlet and outlet 282, 284 of supply conduit 280 along the vertical direction V. In addition, top wall 266 of reservoir 260 may face and be positioned at top panel 140. Thus, supply conduit 280 may extend through top panel 140 such that middle portion 286 of supply conduit 280 between reservoir 260 and Venturi pump 270 is positioned above top panel 140 along the vertical direction V. In particular, middle portion 286 of supply conduit 280 may be positioned above top panel 140 along the vertical direction V and be disposed within control panel 110. In such a manner, supply conduit 280 may extend between reservoir 260 and Venturi pump 270.

Referring still to FIGS. 6 through 8, washing machine appliance 100 may further include an additive passageway 300. More specifically, additive passageway 300 may be defined by reservoir 260 and may extend between an inlet 302 defined on top wall 266 and an outlet 304 defined on bottom wall 268. In this manner, additive passageway 300 may extend substantially along the vertical direction V. However, although the illustrated embodiment shows a vertically oriented additive passageway 300, it should be appreciated that additive passageway 300 may be oriented at any suitable angle in alternative exemplary embodiments.

According to the illustrated embodiment, inlet 302 of additive passageway 300 is positioned at bleach opening 144 of top panel 140. In this manner, a user may pour an additive, such as bleach, through bleach opening 144, such that the additive flows through inlet 302 and additive passageway 300 and out of outlet 304. Notably, outlet 304 is in fluid communication with tub 118, such that the bleach may flow directly into tub 118, e.g., into a radial gap between tub 118 and wash basket 120. As best shown in the exemplary embodiment of FIG. 8, additive passageway 300 is positioned proximate a center of reservoir 260 along the lateral direction L. Additive passageway 300 thus provides a user with the ability pour fluid additive through reservoir 260 directly into tub 118.

According to the illustrated embodiment, additive passageway 300 is funnel-shaped, such that inlet 302 has a larger cross sectional area that outlet 304. More specifically, inlet 302 and outlet 304 are substantially circular and the cross sectional area of inlet 302 is approximately six times larger than the cross sectional area of outlet 304. In this manner, fluid additive may be easily poured into the large inlet 302 and additive passageway 300 directs the fluid additive to a smaller outlet 304. However, according to alternative embodiments, additive passageway 300 could be a cylindrical passageway, could have an oblong inlet 302 or outlet 304, or could have any other suitable geometry.

According an exemplary embodiment, outlet 304 of additive passageway 300 is in direct fluid communication with tub 118 such that fluid additive poured into additive passageway 300 falls into tub 118. However, according to alternative embodiments, washing machine appliance 100 may include additional features for directing fluid additive from additive passageway 300 into tub 118. For example, washing machine appliance 100 may define a chute, trough, or channel configured to redirect additive into tub 118. According to still another exemplary embodiment, washing machine appliance 100 may include an additive conduit 306 (see, e.g., FIG. 8) that extends between outlet 304 of additive passageway 300 and tub 118. Additive conduit 306 may be configured to direct fluid additive in additive passageway 300 into tub 118 at a specific location.

Notably, according to the illustrated embodiment, additive passageway 300 is integrally formed with reservoir 260. More specifically, reservoir 260 is formed from a single, continuous piece of material such that it defines additive passageway 300. In this regard, reservoir 260 may be constructed from any suitably rigid material. For example, according to the illustrated embodiment, reservoir 260 is blow molded with polypropylene such that it defines additive passageway 300. However, according to alternative embodiments, reservoir 260 may be injection molded using a suitable plastic material, such as polypropylene.

Notably, prior washing machine appliances have required multiple parts and a more complex assembly process to provide receptacles for two different wash additives. For example, a bulk dispenser box and a bleach cup would be separately manufactured, e.g., by injection molding. Each of these components would require separate design, tooling, procurement, and storage. Moreover, such a configuration would result in more walls, mounting features, and plumbing installed within the limited space under the top panel of the washing machine appliance. Assembly and installation of additional parts results in increased costs, more complex assembly and extended manufacturing times, and more wasted volume under top panel, which might otherwise be used to store additional bulk detergent.

According to an exemplary embodiment, a trim cap 310 (FIG. 2) may be positioned around bleach opening 144 on top panel 140. Trim cap 310 may be a plastic ring that is snapped onto top panel 140 or to additive passageway 300 to cover bleach opening 144 and inlet 302. In this manner, trim cap 310 provides a clean edge through which a user may pour bleach, and trim cap 310 can assist in directing the poured bleach into inlet 302 of additive passageway 300. Moreover, according to some exemplary embodiments, trim cap 310 may have any suitable contour to assist in preventing the splashing of additive as it is poured through inlet 302. Although trim cap 310 is described above as a plastic ring, it should be appreciated that trim cap 310 may have any suitable geometry and may be constructed of any suitable material to improve the aesthetics of top panel 140 and to assist a user in adding bleach additive to washing machine appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet having a top panel; the top panel of the cabinet defining a first opening and a second opening;

a tub disposed within the cabinet below the top panel;

a basket rotatably mounted within the tub; and an additive reservoir positioned below the top panel, the additive reservoir defining a storage chamber, a reservoir inlet positioned at the first opening of the top panel for receiving a first fluid additive, and an additive passageway for receiving a second fluid additive, the additive passageway extending through the additive reservoir between a passage inlet positioned at the second opening of the top panel and a passage outlet such that the additive passageway is entirely surrounded by the storage chamber with the exception of the passage inlet and the passage outlet and such that the additive passageway bypasses and is not in fluid communication with the storage chamber within the additive reservoir.

2. The washing machine appliance of claim 1, wherein the additive passageway is funnel-shaped.

3. The washing machine appliance of claim 1, wherein the additive passageway is integrally formed with the additive reservoir.

4. The washing machine appliance of claim 1, wherein the additive reservoir is injection molded as a single, integral piece of plastic.

5. The washing machine appliance of claim 1, wherein the passage inlet of the additive passageway is configured to receive the second fluid additive.

6. The washing machine appliance of claim 5, wherein the first fluid additive is detergent and the second fluid additive is bleach.

7. The washing machine appliance of claim 1, wherein the passage outlet of the additive passageway is in fluid communication with the tub such that the second fluid additive poured into the additive passageway flows into the tub.

8. The washing machine appliance of claim 1, further comprising an additive conduit, the additive conduit extending between the passage outlet of the additive passageway and the tub and being configured to direct the second fluid additive in the additive passageway into the tub.

9. The washing machine appliance of claim 1, wherein the additive reservoir defines a vertical direction, a lateral direction, and a transverse direction that are mutually perpendicular to one another, wherein the additive passageway extends between the passage inlet and the passage outlet along the vertical direction.

10. The washing machine appliance of claim 9, wherein the cabinet extends between a front portion and a rear portion along the transverse direction, the first opening of the top panel being positioned at the front portion of the cabinet, the second opening of the top panel being positioned closer to the rear portion of the cabinet relative to the first opening.

* * * * *